US008157304B2

(12) United States Patent
Fredriksson

(10) Patent No.: US 8,157,304 B2
(45) Date of Patent: Apr. 17, 2012

(54) LIFTING SLING SYSTEM

(75) Inventor: Lars Fredriksson, Akersberga (SE)

(73) Assignee: Frenolink Förvaltnings AB, Akersberga (SE)

( * ) Notice: Subject to any disclaimer, the term of this patent is extended or adjusted under 35 U.S.C. 154(b) by 768 days.

(21) Appl. No.: 12/088,462

(22) PCT Filed: Oct. 6, 2005

(86) PCT No.: PCT/SE2005/001480

§ 371 (c)(1),
(2), (4) Date: Jul. 9, 2008

(87) PCT Pub. No.: WO2007/040430

PCT Pub. Date: Apr. 12, 2007

(65) Prior Publication Data

US 2008/0315604 A1 Dec. 25, 2008

(51) Int. Cl.
*B66C 1/14* (2006.01)

(52) U.S. Cl. ..... 294/82.11; 294/74; 59/93

(58) Field of Classification Search ..... 294/74, 294/82.1, 82.11; 59/85, 86, 93; 116/212, 116/DIG. 34; 40/300, 316

See application file for complete search history.

(56) References Cited

U.S. PATENT DOCUMENTS

| | | | | | |
|---|---|---|---|---|---|
| 4,094,141 | A * | 6/1978 | Rehbein | 59/93 |
| 4,139,956 | A * | 2/1979 | Sharrow | 40/316 |
| 4,264,097 | A | 4/1981 | Rehbein | |
| 4,439,067 | A * | 3/1984 | Bakk et al. | 405/184.5 |
| 4,556,246 | A * | 12/1985 | Millington | 294/82.11 |
| 5,193,480 | A * | 3/1993 | Garrett | 116/200 |
| 5,601,326 | A * | 2/1997 | Smetz | 294/82.1 |
| 5,775,754 | A * | 7/1998 | Fredriksson | 294/82.11 |
| 5,884,950 | A * | 3/1999 | Fredriksson | 294/82.11 |
| 6,648,388 | B2 * | 11/2003 | Fredriksson | 294/74 |

FOREIGN PATENT DOCUMENTS

| | | | |
|---|---|---|---|
| EP | 0 105 022 | A2 | 4/1984 |
| EP | 0868386 | A1 | 10/1998 |
| EP | 1 136 419 | A2 | 9/2001 |
| FR | 2658803 | A1 | 8/1991 |
| GB | 2138919 | A | 10/1984 |
| JP | 3-7178 | U | 1/1991 |
| JP | 10072182 | | 3/1998 |
| WO | 9212922 | | 8/1992 |

* cited by examiner

*Primary Examiner* — Dean Kramer

(74) *Attorney, Agent, or Firm* — Duane Morris LLP; J. Rodman Steele, Jr.; Gregory M. Lefkowitz

(57) ABSTRACT

There is disclosed a lifting sling system for connecting various loads to a lifting hook (1), comprising a small number of combinable lifting sling units (10, 20), each consisting of a number of pre-assembled parts (11, 12, 13; 21, 22, 23). These units include at least one dual lifting sling unit (20) and possibly no more than two single lifting sling units (10). The units can be combined in a small number of predetermined combinations in accordance with information provided on an information carrier (32) which is permanently attached to the lifting sling system.

15 Claims, 8 Drawing Sheets

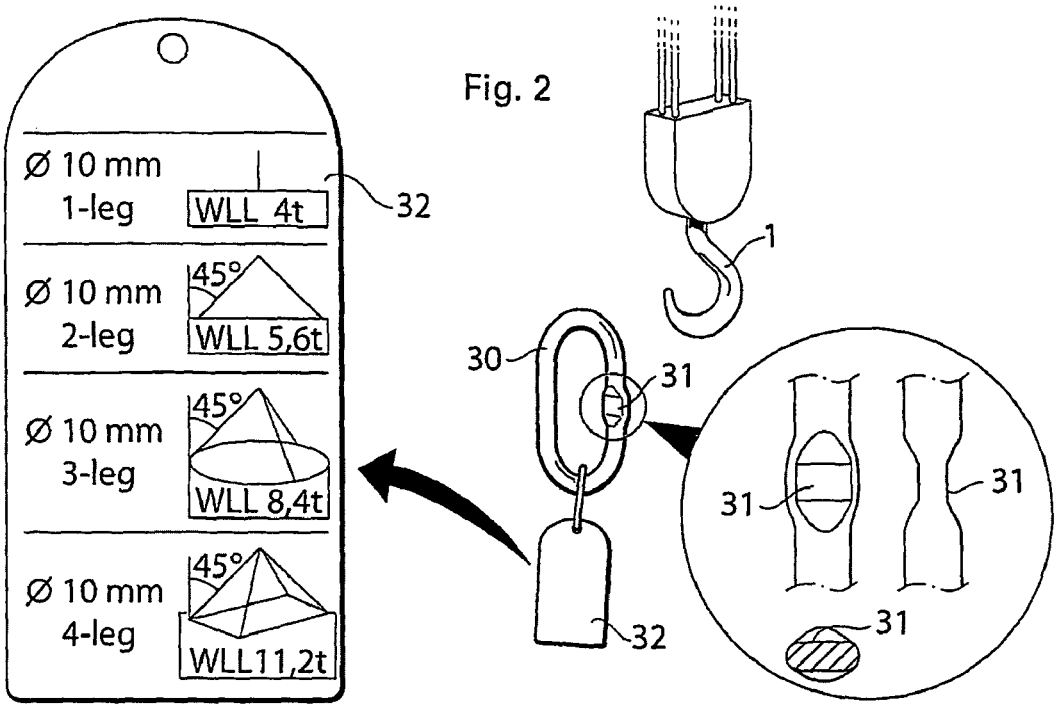
Fig. 2
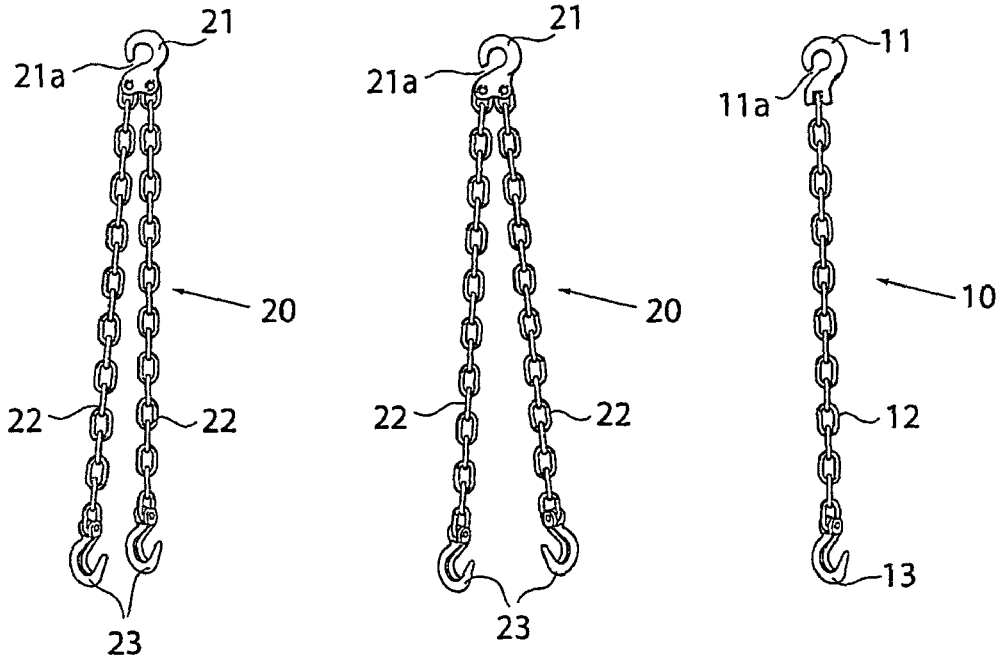
Fig. 2a
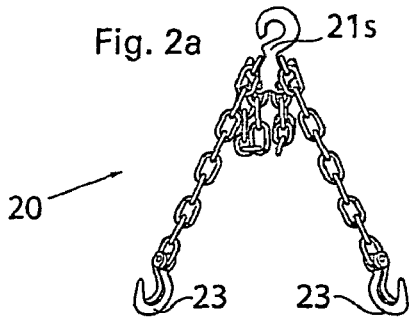

LIFTING SLING SYSTEM

FIELD OF THE INVENTION

The invention relates to a lifting sling system for connecting various loads to a lifting hook, such as a crane hook or a hook operated by some other lifting machinery. The system comprises a set of lifting sling units each consisting of a number of inseparable parts including a coupling member, to be coupled to the lifting hook, one or more sling leg portions, and a connector at the end of each sling leg portion, the lifting sling system permitting selective coupling of at least one of the lifting sling units, at a lifting site, to the lifting hook. The lifting sling system also includes an information carrier containing information concerning specific work load limits to be observed.

PRIOR ART

A currently used lifting sling system of this kind is illustrated in FIGS. 1*a*, 1*b* and 1*c*. Each lifting sling unit, having pre-assembled inseparable parts, comprises a head link or master link, a coupling member for each leg portion, a number of interconnected chain links for each leg, these legs having normally the same length, and a sling hook or some other fitting as a lower terminal or connector for each leg portion. The assembly of each lifting sling unit is made by an authorized person with the required competence in an assembly workshop ("sling shop") where special assembly tools are used for making the sling as an integral unit with inseparable parts. These parts are not supposed to be taken apart in operation at a lifting site, except for possible inspection by an authorized person.

The lifting capacity of each sling unit, normally called the Working Load Limit (WLL), is based on the chain dimension, the number of legs which are all assumed to carry an equal part of the load and the angle of each leg to the vertical, and is indicated on a metal sling tag, which is permanently attached to the master link or elsewhere at the top of each lifting sling unit. In general, when there are different loads to be handled, e.g. with mobile cranes, every crane needs to be equipped with four different and separate lifting sling units containing one, two, three and four legs, respectively, as illustrated in FIG. 1*a*. Hereby, a proper and secure lifting can be achieved for different kinds of loads.

For multi-leg lifting sling units, there are different methods of rating and presenting the working load limit (WLL). Table 2A (below) illustrates the rating for a special use, where all legs carry an equal load, and the legs have an angle of 45° to the vertical:

TABLE 2A

| special use | | | | |
|---|---|---|---|---|
| Chain size (mm) | WLL (t) 1-leg | WLL (t) 2-leg*) | WLL (t) 3-leg*) | WLL (t) 4-leg*)**) |
| 6 | 1.5 | 2.1 | 3.1 | 4.2 |
| 8 | 2.5 | 3.5 | 5.2 | 7.0 |
| 10 | 4.0 | 5.6 | 8.4 | 11.2 |
| 13 | 6.5 | 9.1 | 13.6 | 18.2 |
| 16 | 10 | 14 | 21 | 28 |
| 20 | 16 | 22 | 33 | 44 |

*)WLL for 2-, 3- and 4-leg are given for leg angle of 45° to vertical.

**)WLL for four legs apply based on that special measures are taken that each leg is carrying equal share of the load. Otherwise WLL for three legs will apply.

Thus, all legs should carry an equal load, also for four-leg sling units. Special measures are required to make sure that the legs in a four-leg sling do in fact carry an equal load. The leg angle to the vertical can be selected to any reasonable value, but in this particular example, the WLL is based on an angle of 45°.

In table 2B, below, there is shown the rating for general use, where all legs should carry an equal load for sling units with two and three legs, respectively:

TABLE 2B

| general use | | | | | |
|---|---|---|---|---|---|
| Chain size (mm) | WLL (t) 1-leg | WLL (t) 2-leg, 45° | WLL (t) 2-leg 60° | WLL (t) 3 + 4-leg 45° | WLL (t) 3 + 4-leg 60° |
| 6 | 1.5 | 2.1 | 1.5 | 3.1 | 2.2 |
| 8 | 2.5 | 3.5 | 2.5 | 5.2 | 3.7 |
| 10 | 4.0 | 5.6 | 4.0 | 8.4 | 6.0 |
| 13 | 6.5 | 9.1 | 6.5 | 13.6 | 9.7 |
| 16 | 10 | 14 | 10 | 21 | 15 |
| 20 | 16 | 22 | 16 | 33 | 24 |

On the other hand, for four-leg sling units, only three legs are considered to carry the load, because no special measures are taken for equal distribution of the load. Also, in this example, WLL is indicated for two angles to the vertical, viz. 45° and 60°, respectively.

As an alternative (not shown), the WLL can be rated based on the leg angle to the horizontal (rather than the vertical).

Risks and Inefficiencies in Prior Art Systems

Long term experience from lifting sling systems of the kind described above have shown some safety risks as well as inefficiencies in respect of practical operation and costs.

The lifting sling units for big size chains with units having three or four legs are very heavy to handle manually, especially when attaching such a sling unit to a lifting hook. Table III, below, indicates the typical weight, for different chain sizes, of a lifting sling unit including a master link, joining members and the various chain legs, each having a length of about 1.5 m. These weights have to be lifted manually at the lifting site.

TABLE 3

| weight of lifting sling units with four legs | |
|---|---|
| Chain size (mm) | Weight (kg) |
| 13 mm | 40 kg |
| 16 mm | 60 kg |
| 20 mm | 93 kg |

Such heavy weights will of course involve a safety risk for those who manually handle the lifting sling units.

Moreover, it frequently happens that a particular lifting sling unit, intended for use with all leg portions being active, is fitted to the load with only a few leg portions. Then, the partial load taken up by each active leg portion, will be substantially higher than the intended one, and also being indicated on the associated sling tag. In such a case, the actual load on each sling leg portion is higher. Consequently there will be a risk of overloading even if the operator observes the working load limits indicated on the sling tag. As an example, in table 2A above, the working load limit for a three leg chain sling unit of chain size 10 mm is 8.4 tons. However, in case only two legs are used for lifting and one leg portion is idle, the actual maximum load should be 5.6 tons, a value which does not appear on the sling tag being used in the prior art systems. Clearly, this involves a clear risk of overload.

Another risk involved in using multileg lifting sling units, where some of the leg portions are hanging idle during the lifting operation, the remaining leg portions will be allowed to swing around in the air without control, thereby possibly hitting people in their heads or being inadvertently caught by other objects or edges. Of course, this will bring about a serious risk for accidents and personal injuries during the lifting operation.

As a matter of economy and efficiency, it is desirable to keep down the weight of the lifting sling equipment, especially for mobile cranes and cranes mounted on lorries and the like, thereby saving fuel and increasing the active transportation capacity. From this point of view, there is a need for higher flexibility and a minimum amount of equipment. In the prior art example illustrated in FIG. 1, there are four different lifting sling units having one, two, three and four leg portions, respectively, depending on the type of load to be lifted. All in all, this adds up to 1+2+3+4=10 chain leg portions and four master links, one for each lifting sling unit, as appears from FIG. 1*a*.

Moreover, as illustrated in FIGS. 1*b* and 1*c*, it is of course possible to combine a number of lifting sling units each having only one or two sling legs. However, the sling tags will not indicate the correct working load limit, but a smaller one (5.6 tons instead of 8.4 tons) which is clearly inefficient and misleading.

OBJECT OF THE INVENTION

With this background, a primary object of the present invention is to increase the operational safety of the lifting sling system.

Another object is to reduce the number of parts included in the system, thereby reducing costs and increasing the overall efficiency.

SUMMARY OF THE INVENTION

According to the present invention, the above stated objects are met for a lifting sling system having the features stated in claim 1. Accordingly, the system includes only a small number of lifting sling units, including at the most two (zero, one or two) units with only a single sling leg portion and one, two or three lifting sling units each having a pair of sling leg portions. There should be no lifting sling unit in the system having more than two sling leg portions, there being at least one permissible combination with a total of two sling leg portions but no permissible combination of lifting sling units having more than a total of four sling leg portions. The various lifting sling units are adapted for selective coupling a particular load to the lifting hook in accordance with information provided on an information carrier, such as a sling tag, being permanently attached to the lifting sling system. Possibly, the lifting sling system also includes at least one further information carrier as a free component containing the same information as the one which is permanently attached to a member forming a part of the lifting sling system.

In this way, the number of different lifting sling units will be kept to a minimum, and each lifting sling unit will be relatively light in weight and easy to handle.

Preferably, the system also comprises one, two or three head link assemblies, each head link assembly having a head link dimensioned to be hung onto the lifting hook and adapted for quick-coupling to at least one or two of the lifting sling units. Possibly, the head link assembly includes one or two sub-links, e.g. having a flattened portion with reduced thickness so as to enable quick coupling thereof, at the lifting site, to a coupling member of an associated lifting sling unit.

An important aspect of the present invention is to provide an information carrier, such as a lifting sling tag, for use in a lifting sling system with no more than two single lifting sling units and at least one but no more than three dual lifting sling units, the information carrier providing information addressed to any user of the system at a lifting site, concerning permitted work load limits to be observed for a small number of combinable lifting sling units. Hereby, it will be ensured that the indicated working load limits will not be exceeded in practice, and also that the capacity of the lifting sling units can be used in an optimal way.

Further advantages and features of the invention will be apparent from the detailed description below, reference being made to the accompanying drawings.

BRIEF DESCRIPTION OF THE DRAWINGS

FIGS. 2 and 2*a* illustrate schematically a first embodiment of a
lifting sling system according to the present invention;

DETAILED DESCRIPTION OF PREFERRED EMBODIMENTS

Figure 1A:
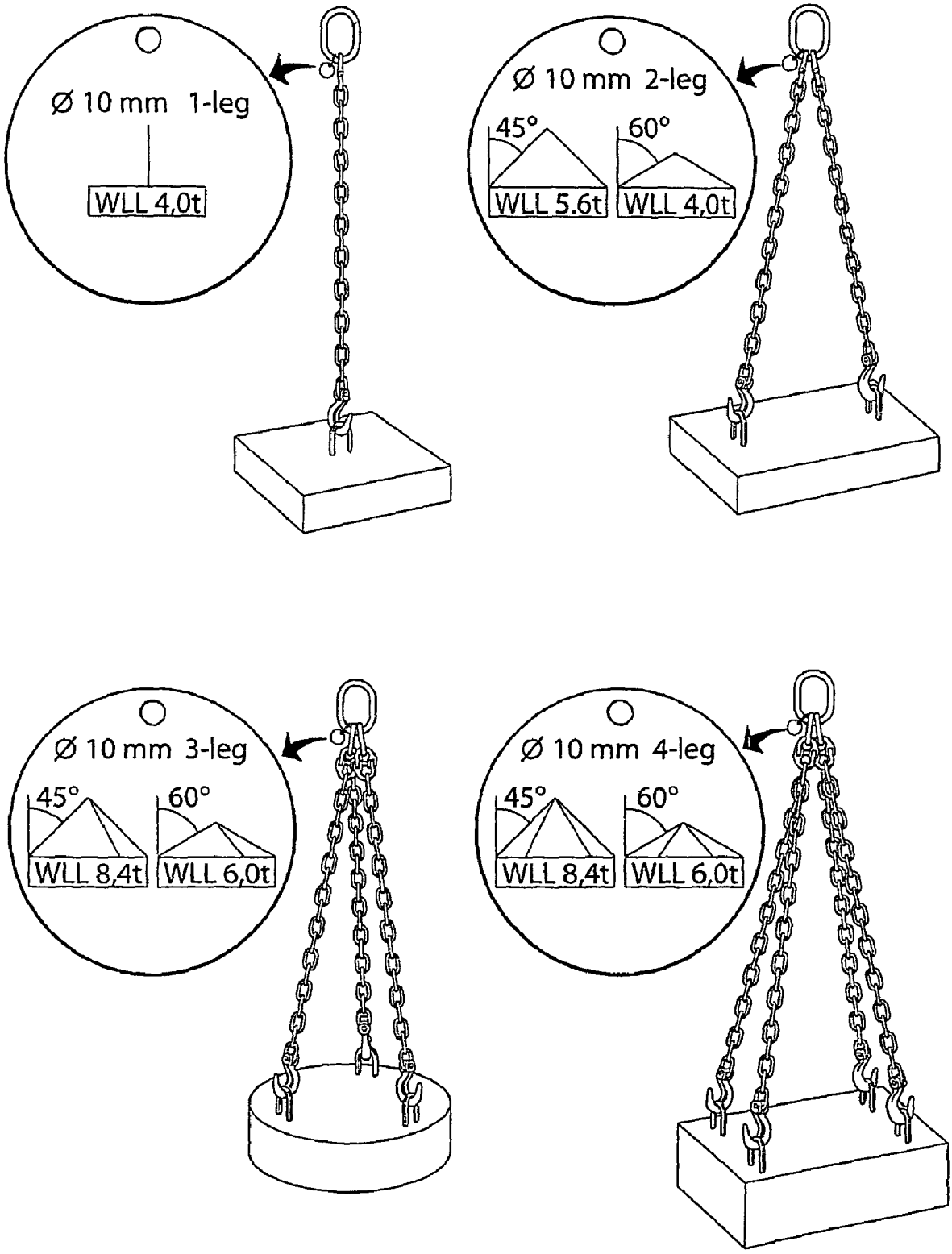
Fig. 1a (prior art)
FIG. 1*a*, 1*b* an 1*c* illustrate schematically a prior art lifting sling system including lifting sling units with different numbers of leg portions in each unit.
Figure 1B:
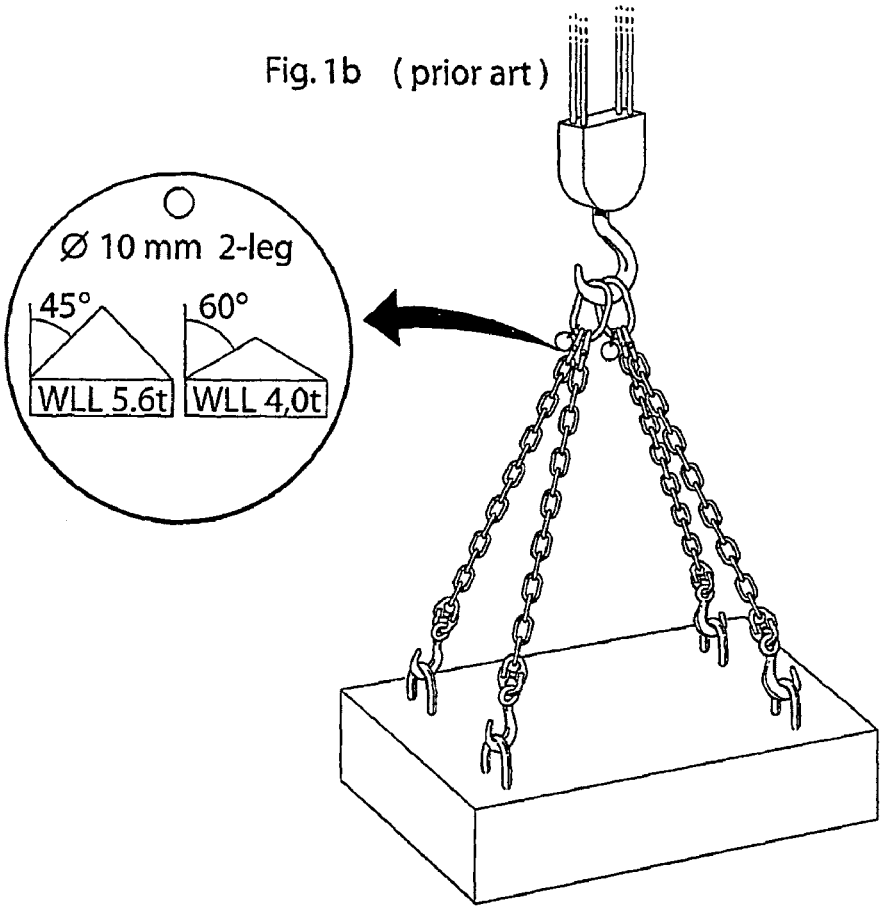
Fig. 1b (prior art)
Figure 1C:
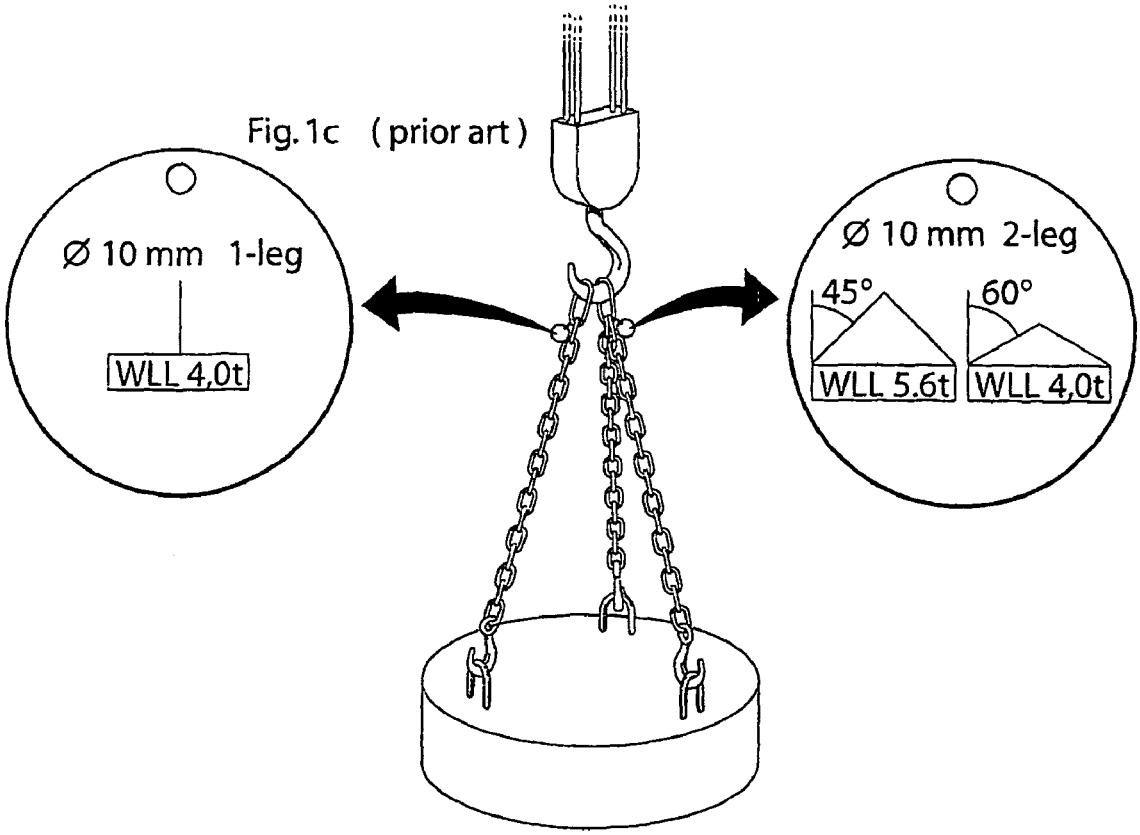
Fig. 1c (prior art)

In FIG. 2, there is shown a first embodiment of the lifting sling system according to the invention. The system includes a relatively small number of combinable lifting sling units, namely two dual lifting sling units 20 and one single lifting sling unit 10. The single lifting sling unit 10 consists of three pre-assembled, inseparable members being permanently connected to each other, viz. a single coupling member in the form of a hook 11 which is quick-connectable to a lifting hook 1 via a closed head-link 30, a single sling leg 12 connected to the coupling hook 11, and a connector in the form of a hook 13 at the end of the single sling leg 12 for connection to a load at a lifting site.

Similarly, each dual lifting sling unit 20 consists of five pre-assembled, inseparable members being permanently connected to each other, viz. a dual coupling member in the form of a hook 21, which is quick-connectable to the lifting hook 1 via the closed head-link 30, a pair of sling legs 22 connected to the dual coupling hook 21, and two connectors in the form of hooks 23 at the end of each sling leg for connection to the load at the lifting site.

The quick-connectable hooks 11, 21 and the head-link 30 are of the kind disclosed generally in EP 868386 B1. Thus, the head-link 30 has a flattened portion 31 with reduced thickness, and the hook 11 and 21, respectively, has a hook portion with a limited hook opening 11A and 21A, respectively, fitting snugly onto the flattened portion of the head-link. Thus, the hook opening 11*a*, 21*a* is smaller than the material thickness of the head-link 30 but larger than the reduced thickness at said flattened portion 31.

In use, at a lifting site, one or two of these lifting sling units 10, 20 are coupled to the head-link 30, which in turn can be hung onto the lifting hook 1. Thus, with this lifting sling system consisting of the head-link 30, the single lifting sling unit 10 and the two dual lifting sling units 20, it is possible to select a suitable combination of lifting sling units so as to obtain a required number of sling leg portions to be coupled to a load, namely one single leg portion, using the lifting sling unit 10, two leg portions, using one of the dual lifting sling units 20, three leg portions, using the single lifting sling unit 10 and one of the dual lifting sling units 20, or four leg portions, using the two dual lifting sling units 20.

An information carrier in the form of a sling tag 32 is permanently attached to the head-link 30. The sling tag has clear markings showing the various possible combinations of the lifting sling units, and the associated working load limits to be observed for each such combination. As appears at the upper left part of FIG. 2, these combinations are clearly visible to the user. In this case, it is assumed that the sling leg angle to the vertical is no more than 45°. Also, it is assumed that all leg portions are uniformly loaded even in the case of four sling legs being used. The working load limit values correspond to those shown in table 2A above for the chain size 10 mm.

According to the invention, it is essential that the lifting sling system includes only a small number of lifting sling units so as to keep down the amount of hardware. Another essential feature is that there should be no heavy lifting sling units. So the maximum number of sling leg portions in a lifting sling unit is two, and there is no lifting sling unit with more than two leg portions.

As illustrated in FIG. 2*a*, at least one of the lifting sling units may be provided with a shortening device, e.g. in the form of a coupling hook 21S having such a function integrated in its structure or as a separate component (not shown).

Figure 3:
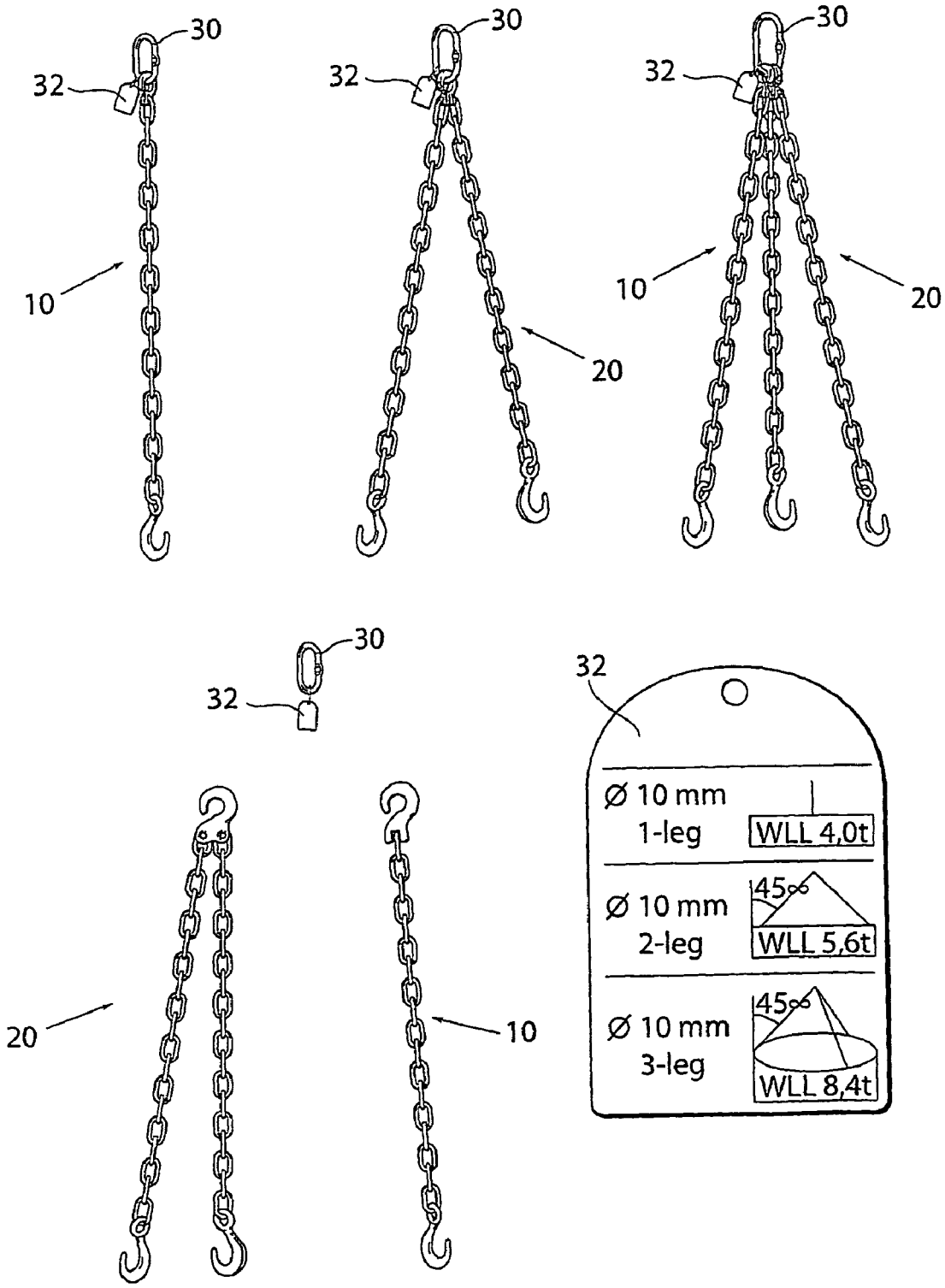
FIG. 3 illustrates, even more schematically, a second embodiment of a lifting sling system according to the present invention.

In FIG. 3, there is illustrated an even simpler embodiment with only two lifting sling units (shown at the lower portion of FIG. 3), namely one single lifting sling unit 10 and one dual lifting sling unit 20 as well as a closed head-link or master-link 30 with a sling tag 32. The latter is shown in larger scale to the right in FIG. 3.

With this embodiment, it is possible to use only the single lifting sling unit 10, only the dual lifting sling unit 20 or a combination of these lifting sling units 10, 20, as illustrated in the upper part of FIG. 3.

Figure 4:
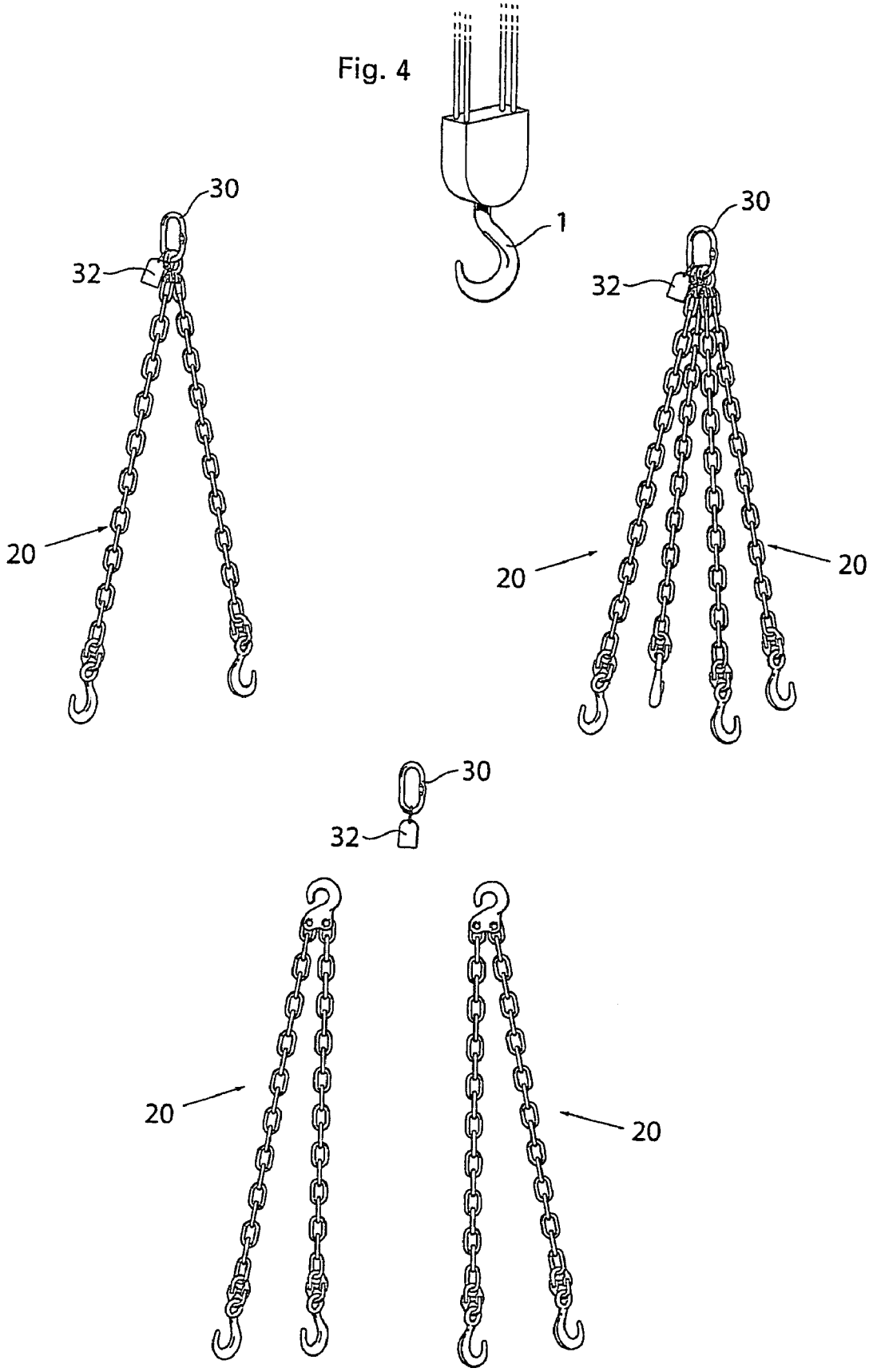
FIG. 4 illustrates, likewise very schematically, a third embodiment of a lifting sling system according to the present invention.

Another embodiment with only two lifting sling units is shown in FIG. 4. Here, the lifting sling system consists of two dual lifting sling units 20, shown in the lower part of FIG. 4. Here, it is possible to use only one dual lifting sling unit 20, as shown at the upper left in FIG. 4, or a combination of the two lifting sling units 20, as shown at the upper right in FIG. 4. In either case, the sling unit or combination thereof can be hooked onto the lifting hook 1 with the closed head-link 30. In this case, the sling tag 32 is not shown in detail, but the information contains information for the two options, viz. with two legs and four legs, respectively.

Figure 5:
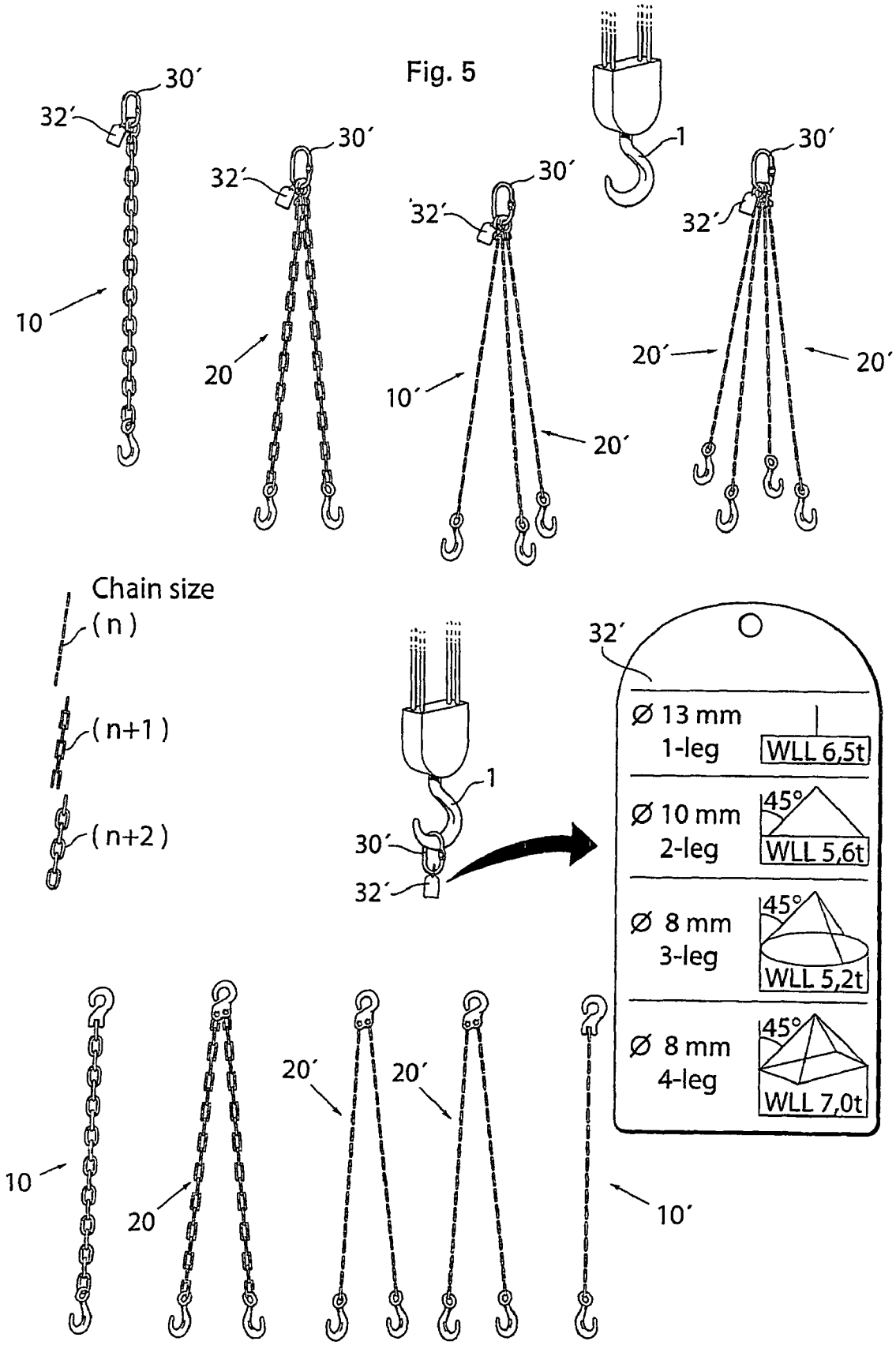
FIG. 5 illustrates, likewise very schematically, a fourth embodiment of lifting sling system according to the present invention.

In FIG. 5, there is shown a lifting sling system having altogether five lifting sling units as shown at the lower part of FIG. 5. In this case, the various lifting sling units have different chain sizes, including a largest size (n+2), a next smaller size (n+1) and a smallest size (n), e.g. with n+2=13 mm, n+1=10 mm and n=8 mm. There is one lifting sling unit 10 with a chain size n+2, one dual lifting sling unit 20 with chain size n+1, two dual lifting sling units 20' with chain size n and one single lifting sling unit 10', likewise with the chain size n.

With such differentiation of the chain size among the lifting sling units, it is possible to carry approximately the same total load with one, two, three or four leg portions, as clearly indicated on the sling tag 32' to the right in FIG. 5. The four combinations indicated on the sling tag 32' are shown in the upper part of FIG. 5. Of course, the selection of a particular combination depends on the size and shape of the load (not shown).

With a lifting sling system as illustrated in FIG. 5, it is thus possible to make more efficient use of the capacity of the crane even for a reduced number of legs, for combinations with one and two leg portions. Compare table 2A above.

It will be apparent that the total number of sling leg portions, and the total weight of the lifting sling system according to the invention, is substantially reduced in comparison to the prior art systems (compare FIG. 1*a*). For example, in the system shown in FIG. 2, there are only five sling leg portions altogether, whereas in the prior art system shown in FIG. 1*a*, there are in total ten such sling leg portions.

Still, the safety is increased, since the user will have a clear indication of the permissible combinations on the sling tag being an integral part of the system, irrespective of the particular combination being used.

Furthermore, of course, the weight of each lifting sling unit 10, 20, 10' or 20' to be handled is much less than the prior art combinations involving three or four sling leg portions.

It is not absolutely necessary to use a closed head-link 30, as shown in FIGS. 2, 3, 4 and 5. Thus, the head-link may be an open link, or the coupling hook 11 or 21 may be designed so as to be hung directly onto the lifting hook 1. If so, each lifting sling unit should be provided with individual sling tags indicating all the permissible combinations of the various lifting sling units.

Figure 6A:
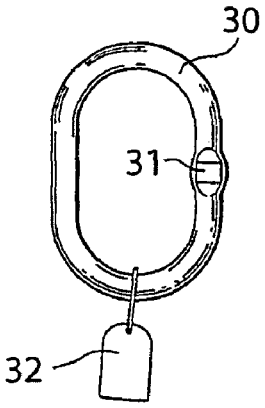
FIGS. 6*a*, 6*b* and 6*c* illustrate various head-link assemblies included in a lifting sling system according to the present invention.
Figure 6B:
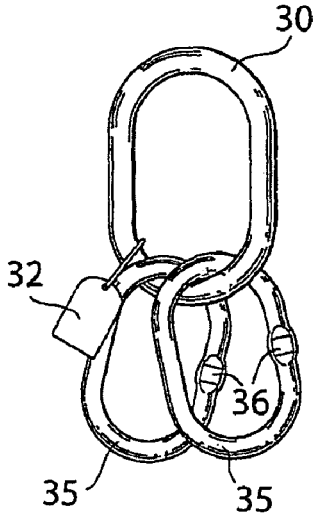
Figure 6C:
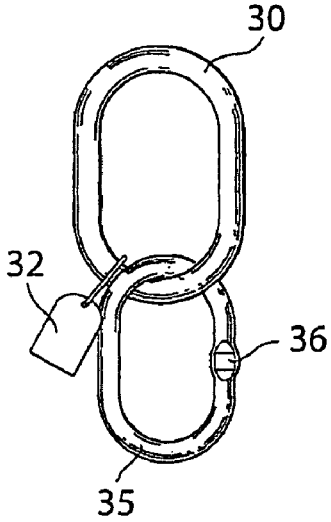
Figure 7A:
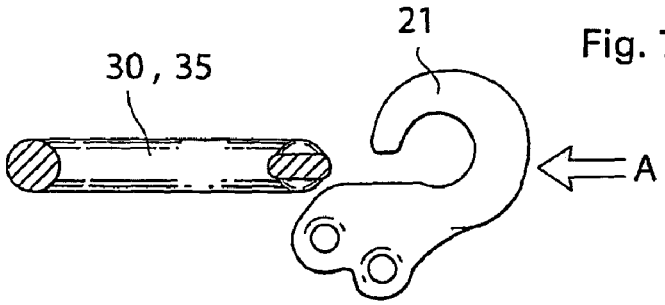
FIGS. 7*a*, 7*b* and 7*c* illustrate schematically three embodiments of a coupling member which is quick-connectable to a head link assembly.

Alternatively, it may be advantageous to use a head-link assembly having one (FIG. 6*c*) or two (FIG. 6*b*) sub-links 35 permanently coupled thereto, rather than the single head-link or master-link as shown in FIG. 6*a*. When using such sub-links 35, the main head-link 30 is preferably uniform in thickness, whereas each sub-link 35 may have a flattened portion 36 corresponding to the flattened portion 31 on the head-link 30 shown in FIGS. 2 through 5. When using two sub-links 35, as shown in FIG. 6*b*, each sub-link 35 should be quick-coupled to a coupling hook (or possibly two coupling hooks), e.g. of a kind shown in FIG. 2. A dual coupling hook 21 is also shown in FIG. 7*a*, together with an associated head-link 30 or sub-link 35. An arrow A indicates the movement for coupling the hook 21 onto the head-link 30 or sub-link 35.

Figure 7B:
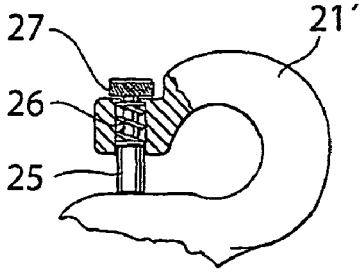

In FIG. 7*b*, there is shown a similar coupling hook 21' provided with a latch pin 25 which is held in a locking position, as shown, by means of a helical spring 26. The latch pin 25 can be opened by pulling the pin 25 manually at its head member 27 against the action of the spring 26.

Figure 7C:
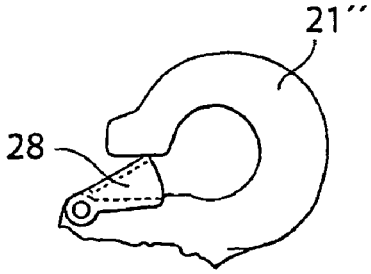

Another hook 21" with a slightly different latch member 28 is shown in FIG. 7*c*. The latch member 28 is pivotally journalled and is likewise held in a locking position by means of a spring member (not visible in FIG. 7*c*).

The quick coupling may thus be achieved by means of a flattened head-link or sub-link, or by way of coupling hook member having a gap accommodating the full cross-sectional diameter of a head-link or a sub-link but being provided with a locking member, e.g. of the kind shown in FIGS. 7*b* and 7*c*.

Figure 8:
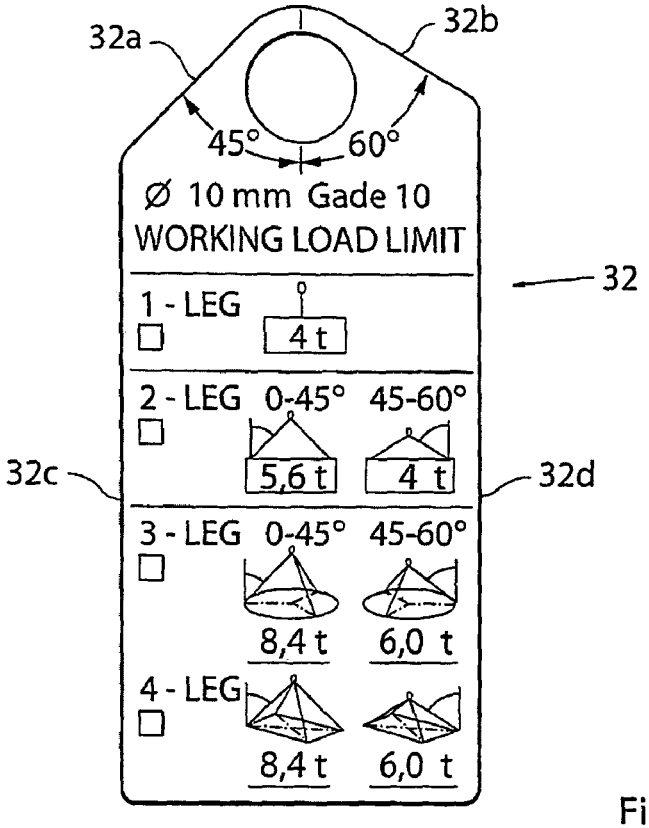
FIG. 8 shows a sling tag to be used for lifting sling system with 10 mm chain links for general use, i.e. without any special measures being taken for equal distribution of the load when a total of four sling leg portions are being used.

In FIG. 8 there is shown a sling tag containing more information, viz. the working load limits for leg angles up to 45° and angles in the interval 45-60°, respectively, for each permissible combination of lifting sling units. It is important that the user of a particular lifting sling system will always be able to obtain information from a sling tag or some corresponding information carrier concerning the work load limits of the permitted-combinations of lifting sling units. In case head-links are used, each head-link 30, see FIG. 6*a*, 6*b*, 6*c*, should be provided with an information carrier. Otherwise, each lifting sling unit should have such an information carrier. Of course, different kinds of information carriers can be used, providing the necessary visual information or, alternatively, in some other way, e.g. audio.

The lifting sling system may include one or more additional sling tags or information carriers which constitute freely movable components and containing substantially the same information as the information given on the information carriers being permanently attached to one or several members forming integral parts of the lifting sling system.

The sling tag of FIG. 8 may constitute such an additional sling tag, e.g. a duplicate copy of a sling tag permanently attached to a head-link assembly or some other component. When being used as a free component, an operator of the lifting sling system may pick up the extra sling tag and compare it with the actual lifting sling combination being used at a lifting site. A special feature of the sling tag of FIG. 8 is the upper part with two edge portions 32*a* and 32*b* standing at an angle to the longer side edges 32*c*, 32*d*, corresponding to the actual angle (45° and 60°) of one or more permissible combinations of lifting sling units. The operator can easily compare these angles with the respective actual sling leg portions at the lifting site.

It is also important that the various parts of a particular lifting sling system are identified or marked so as to indicate that each unit belongs to a certain lifting sling system. Such marking can be made by colour coding with the same colour to be applied e.g. on top of each lifting sling unit and on each head-link assembly. Alternative, special tags or sleeves may be attached on or around each unit. Such tags or sleeves may alternatively be provided with numbers or letter codes indicating the particular lifting sling system.

Instead of chains, it would be possible to use wire ropes or fibre slings, such as fibre round slings or fibre webbing belts, for the leg portions of each sling unit. Of course, the quick-coupling members may be constituted by other members than hooks. Also, the terminal ends of each leg portion may be attached to other kinds of connectors or coupling members for secure attachment to a particular load.

Figure 9:
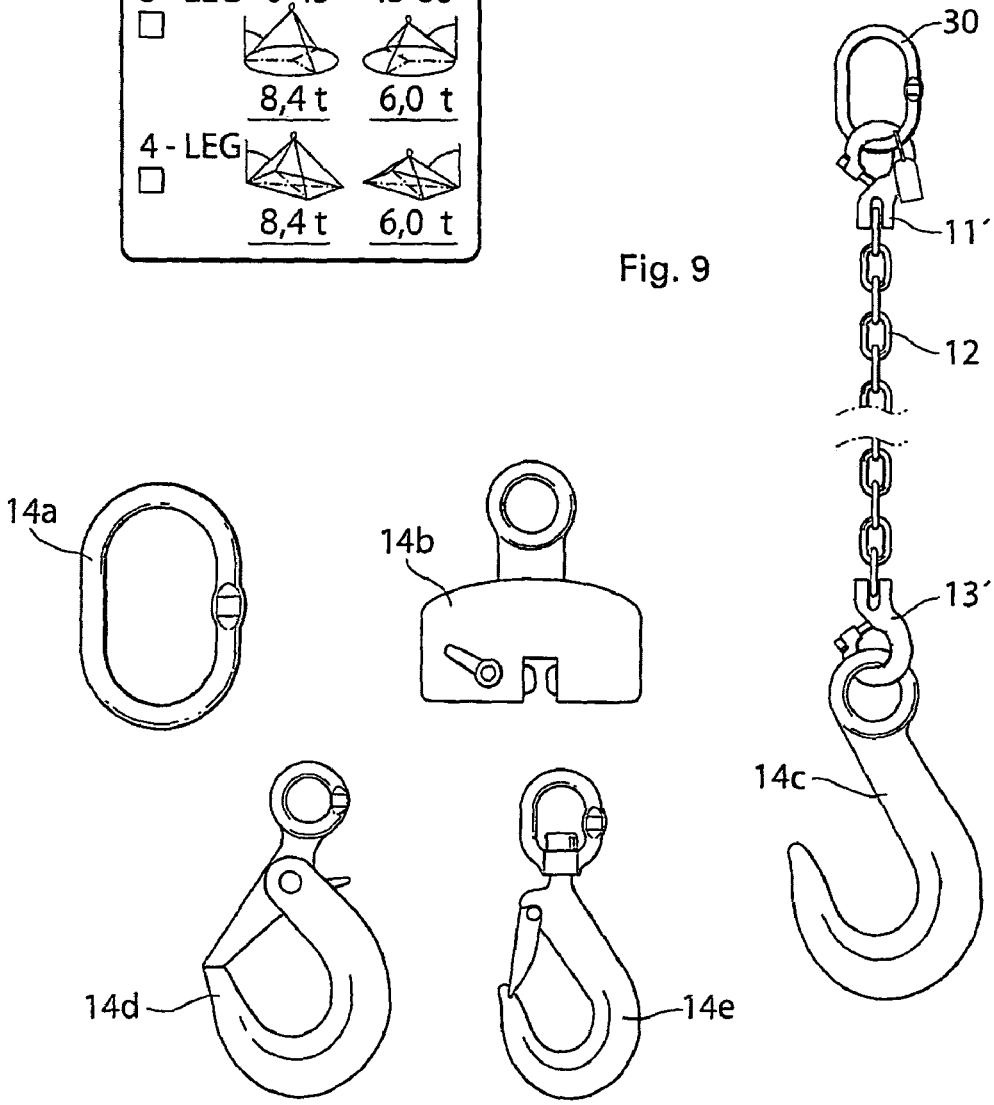
FIG. 9 shows a lifting sling unit having a connector at its lower end which is adapted for quick coupling to a selected end component.

Finally, as illustrated in FIG. 9, the connector at the lower end of the sling leg may be constituted by a quick-connectable coupling member 13', e.g. similar to the upper coupling member 11'. In this way the lower connector 13 can be swiftly connected to a particular end component, selected by the operator at the lifting site, such as an end link 14*a*, a plate clamp 14*b*, a sling hook 14*c*, a self-locking safety hook 14*d*, a swivel hook 14*e* or some other component adapted to the particular load. The coupling portion of the end component may have a flattened portion (14*a*, 14*d*, 14*e*) or a uniform cross-section (14*b*, 14*c*).

Accordingly, as compared to prior art systems, the total number of lifting sling units and associated components is kept to a minimum.

I claim:

1. A lifting sling system for connecting various loads to a lifting hook, comprising a set of lifting sling units each formed of a number of pre-assembled parts including a coupling member, one or more sling leg portions and a connector at an end of each sling leg portion, said lifting sling system permitting selective coupling of at least one of said lifting sling units, at a lifting site, to said lifting hook, wherein said set of lifting sling units comprises at least two and no more than totally five combinable lifting sling units, comprising:

at least one and no more than three dual lifting sling units each formed of five pre-assembled members being permanently connected to each other, said five pre-assembled members comprising:

a dual coupling member which is quick-connectable to said lifting hook at said lifting site, a pair of sling leg portions connected to said dual coupling member, and one connector at the end of each sling leg portion for connection to said load at said lifting site, and no more than two single lifting sling units formed of three pre-assembled members being permanently connected to each other, said three pre-assembled members comprising:

a single coupling member which is quick-connectable to said lifting hook at said lifting site, a single sling leg portion connected to said single coupling member, and a connector at the end of said single sling leg portion for connection to said load at said lifting site, there being no lifting sling unit in the system having more than two sling leg portions, the lifting sling system also comprising:

a head link assembly having a closed head link dimensioned to be hung onto said lifting hook and adapted for quick coupling to at least one and no more than two of said lifting sling units, an information carrier being permanently attached to the lifting sling system, said information carrier containing information concerning (a) permissible combinations of lifting sling units, there being at least one permissible combination of lifting sling units having a total of two sling leg portions but no permissible combinations of lifting sling units having more than a total of four sling leg portions, and (b) specific work load limits to be observed for said permissible combination of lifting sling units, said combinable lifting sling units being adapted for selective coupling of a particular load to said lifting hook in accordance with the information provided on the information carrier.

2. A lifting sling system as defined in claim 1, wherein said closed head link has a flattened portion reduced thickness so as to enable quick-coupling thereof, at said lifting site, to at least one and no more than two of said coupling members of said single and dual lifting sling units.

3. A lifting sling system as defined in claim 1, wherein said head link assembly includes at least one and no more than two sub-links, so as to enable quick-coupling thereof, at said lifting site, to at least one of said coupling members of said single and dual lifting sling units.

4. A lifting sling system as defined in claim 3 wherein each of said coupling members is provided with a hook portion having a limited hook opening which is smaller than the material thickness of said head link or sub-link but larger than a reduced thickness at a flattened portion.

5. A lifting sling system as defined in claim 1, wherein all of said single and dual lifting sling units include leg portions consisting of chain links all having the same size.

6. A lifting sling system as defined in claim 5, wherein said set of lifting sling units consists of one single lifting sling unit and one dual lifting sling unit.

7. A lifting sling system as defined in claim 5, wherein said set of lifting sling units consists of one single lifting sling unit and two dual lifting sling units.

8. A lifting sling system, as defined in claim 5, wherein said set of lifting sling units consists of two dual lifting sling units.

9. A lifting sling system as defined in claim 1, wherein said set of lifting sling units consists of lifting sling units each having chain links of the same size within the same lifting sling unit, the size of the chain links being different between at least two lifting sling units.

10. A lifting sling system as defined in claim 9, wherein there are altogether three different sizes of chain links in the lifting sling system, including a first lifting sling unit having chain links of a largest size, a second lifting sling unit having chain links of a next smaller size, and at least two further lifting sling units having chain links of a smallest size, which lifting sling units are to be used in combinations having altogether at least three and no more than four sling leg portions.

11. A lifting system as defined in claim 10, wherein said set of lifting sling units consists of five lifting sling units, namely:

a first, single lifting sling unit with chain links of said largest size, a second, dual lifting sling unit with chain links of said next smaller size, and three further lifting sling units with said smallest size, said three further lifting sling units comprising:

one single lifting sling unit, and two dual lifting sling units.

12. A lifting sling system as defined in claim 1, wherein said lifting sling units include sling leg portions each consisting of one of the following: a wire rope, a fibre round sling and a fibre webbing belt.

13. A lifting sling system as defined in claim 1, including at least one shortening device for shortening at least one of said sling leg portions at said lifting site.

14. A lifting sling system as defined in claim 1, wherein said connector at the lower end of at least one sling leg portion is constituted by a quick-connectable coupling member, adapted to be connected to a selectable end component.

15. A lifting sling system as defined in claim 1, comprising at least one further information carrier being separate from other components of the lifting sling system and containing the same information as said information carrier being permanently attached to said lifting sling system.

* * * * *